US009587911B2

(12) United States Patent
Wolf

(10) Patent No.: US 9,587,911 B2
(45) Date of Patent: Mar. 7, 2017

(54) MAGNETICALLY STABILIZED FIREARM SIGHT

(71) Applicant: ZEV Technologies, Inc., Oxnard, CA (US)

(72) Inventor: Alec Daniel Wolf, Newbury Park, CA (US)

(73) Assignee: ZEV Technologies, Inc., Oxnard, CA (US)

( * ) Notice: Subject to any disclaimer, the term of this patent is extended or adjusted under 35 U.S.C. 154(b) by 0 days.

(21) Appl. No.: 14/997,393

(22) Filed: Jan. 15, 2016

(65) Prior Publication Data

US 2016/0223291 A1 Aug. 4, 2016

Related U.S. Application Data

(63) Continuation-in-part of application No. 14/565,270, filed on Dec. 9, 2014.

(60) Provisional application No. 61/913,808, filed on Dec. 9, 2013.

(51) Int. Cl.

| | |
|---|---|
| ***F41G 1/16*** | (2006.01) |
| ***F41G 1/26*** | (2006.01) |
| ***F41G 11/00*** | (2006.01) |

(52) U.S. Cl.

CPC ..... *F41G 1/16* (2013.01); *F41G 1/26* (2013.01); *F41G 11/005* (2013.01)

(58) Field of Classification Search

CPC . F41G 1/16; F41G 1/26; F41G 11/005; F41G 1/06; F41G 1/18; F41G 11/001; F41G 11/002; F41G 11/003; F41G 11/004; F41G 1/30

USPC ... 42/148, 139, 135–137, 111–117, 124–127

See application file for complete search history.

(56) References Cited

U.S. PATENT DOCUMENTS

| | | | | |
|---|---|---|---|---|
| 807,812 | A * | 12/1905 | Elterich | F41G 1/26 42/137 |
| 2,438,601 | A * | 3/1948 | Davis | F41G 1/26 42/137 |
| 2,610,406 | A * | 9/1952 | Chambers | F41G 1/033 42/133 |
| D191,112 | S * | 8/1961 | Elliason | D22/109 |
| D199,065 | S * | 9/1964 | Korzeniewski | D22/109 |
| 3,495,339 | A * | 2/1970 | Elliason | F41G 1/26 42/137 |

(Continued)

OTHER PUBLICATIONS

Yam, Hilton, First Look: S&W M&P C.O.R.E, Mounting the Optic, http://modernserviceweapons.com/?p=1289; http://modernserviceweapons.com/?p=1474; Modern Service Weapons. Nov. 30, 2012, Dec. 13, 2012.

*Primary Examiner* — Joshua Freeman

(74) *Attorney, Agent, or Firm* — Knobbe Martens Olson & Bear LLP

(57) ABSTRACT

A sight mechanism for firearms such as pistols, rifles and the like. The sight mechanism includes a sight member that has a rear sight that is vertically adjusted. The sight member can be mounted on a vertically moveable member that has a fixing member that sets the vertical position of the sight member. The vertically moveable member may, without limitation, be a pivoting member. The sight mechanism includes magnets that bias the vertical member against the fixing member so that the magnets maintain the sight at the vertical position defined by the fixing member.

18 Claims, 4 Drawing Sheets

(56) References Cited

U.S. PATENT DOCUMENTS 3,838,522 A * 10/1974 Williams ..... F41G 1/28 42/137
D254,680 S * 4/1980 Behlert ..... D22/109
4,200,989 A * 5/1980 Brouthers ..... F41G 1/26 42/137
4,606,131 A * 8/1986 Domian ..... F41G 1/16 42/137
4,628,611 A * 12/1986 Ruffino ..... F41G 1/16 42/137
5,467,552 A * 11/1995 Cupp ..... F41G 1/26 42/125
5,481,818 A * 1/1996 Stover ..... F41G 1/26 42/136
6,968,643 B2 * 11/2005 Woodbury ..... F41G 1/033 42/137
7,743,546 B2 * 6/2010 Keng ..... F41G 11/003 42/113
8,832,983 B1 * 9/2014 Wolf ..... F41A 3/12 42/16
8,893,422 B2 * 11/2014 Wolf ..... F41A 3/12 42/111
9,267,759 B2 * 2/2016 Speroni ..... F41C 27/00
2006/0207157 A1 * 9/2006 Keng ..... F41G 1/32 42/132
2007/0199227 A1 * 8/2007 Ertl ..... F41G 1/26 42/137
2007/0234625 A1 * 10/2007 Kidd ..... F41G 1/02 42/111
2008/0092424 A1 * 4/2008 Keng ..... F41G 1/28 42/137
2008/0244953 A1 * 10/2008 Kilic ..... F41G 11/004 42/127
2013/0061511 A1 * 3/2013 Strayer ..... F41G 1/26 42/136
2014/0109456 A1 * 4/2014 Jung ..... F41G 1/30 42/113
2015/0198415 A1 * 7/2015 Campean ..... F41G 1/16 42/137
2015/0241175 A1 * 8/2015 Wolf ..... F41G 1/26 42/124

* cited by examiner

MAGNETICALLY STABILIZED FIREARM SIGHT

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57.

BACKGROUND OF THE INVENTION

Field of the Invention

The present invention relates to firearms and, in particular, concerns a firearm with a magnetically stabilized sight.

Description of the Related Art

Firearms such as pistols, rifles and shotguns typically have sights to facilitate the shooter in aiming the firearm. A very common type of sight is known as iron sights that typically have a rear component with an operative mounted towards the rear of the firearm and a front component in the form of a blade or bead located adjacent the end of the barrel of the firearm. To use this type of sight, the shooter looks through the aperture on the rear site and aligns the front component in the aperture and then aims the aligned front component and rear component at the desired target. This results in the barrel of the firearm being levelled and pointed at the desired target.

The front and rear components can comprise a variety of different configurations. The front component can be a simple blade or it can have a bead or other colored implement to make the front component more visible. The rear component can comprise a plate with an aperture cut in the center or it can comprise some other form of device that has an aperture that the shooter looks through or some other component that is aligned with the front sight or with the target. In the plate configuration, the aperture can comprise a slot beginning at the upper surface of the plate or it can comprise a hole in the plate. The slot or hole can have a variety of different configurations.

Often both the front and rear sight are adjustable to allow the shooter to orient the sights to align the barrel with a desired point of aim. The sights can be adjustable in both the vertical orientation which adjusts the elevation of the sight and in the horizontal direction which adjusts the horizontal orientation of the barrel. It is common that the rear component be both adjustable in the horizontal and vertical directions.

In one specific non-limiting example, the rear sight of a firearm such as a pistol includes a mounting assembly that is positioned on an upper surface of a barrel, receiver, slide or other horizontal component of the firearm that is fixed in relationship with the barrel. A swing member is attached to the mounting assembly that is vertically movable. A plate that has the aperture is attached to the swing member such that the plate can be horizontally movable. The swing member typically has springs that urge the swing member upwards and the swing member is restrained by a screw or fastener that opposes the biasing of the spring. To adjust the vertical orientation of the swing and thus of the sight, the user adjusts the vertical position of the screw or fastener and the springs urge the swing member upward against the vertical position of a flange of the fastener.

One difficulty with the vertical sight described above is that the swing member is typically often attached to the mounting assembly via a pivot pin such that the swing member pivots with respect to the pivot pin. This results in the swing member moving in an arc. However, the spring is typically a vertically extending member that exerts force in a linear direction and not in an arc. This can result in difficulty in precisely aligning the vertical orientation of the swing member with respect to the barrel of the firearm. Further, the spring can bind as a result of the miss-match between the vertical force exerted by the spring and the arc movement of the swing member. For shooters who desire very precise positioning of the vertical orientation of the sight, this problem can be significant.

Thus, there is a need for a more precise adjustment of a firearm sight. To this end, there is a need for a vertically adjustable sighting system that has a component exerting force in a vertical direction on a vertically adjustable component of a sight that is consistent with an arc-type motion of the vertical component.

SUMMARY OF THE INVENTION

The aforementioned needs are satisfied by one exemplary embodiment of the present invention which comprises a sight assembly for a firearm comprising a mounting assembly that is adapted to be attached to a firearm in a fixable relationship with respect to the barrel of the firearm; a swing member that is pivotally attached to the mounting assembly wherein the swing member defines a mounting location; a plate having a sighting aperture formed therein mounted on the mounting location of the swing member, wherein the vertical position of the plate is adjustable by pivoting of the swing member with respect to the mounting assembly; and a magnetic biasing component that urges the swing member away from the mounting assembly to maintain the plate at a desired vertical location.

In another implementation the invention comprises a sight assembly for a firearm comprising: a mounting assembly that is adapted to be attached to a firearm in a fixable relationship with respect to the barrel of the firearm; a first movement member that is attached to the mounting assembly so as to be movable with respect thereto in a first direction wherein the first movement member defines a mounting location; a sight being mounted on the mounting location of the first movement member, wherein a first position of the sight is adjustable by movement of the first movement member with respect to the mounting assembly in the first direction; and a magnetic biasing component that urges the first movement member away from the mounting assembly to maintain the sight at a desired first position.

These and other objects and advantages of the present invention will become more apparent from the following description taking in conjunction with the accompany drawings.

DETAILED DESCRIPTION OF THE PREFERRED EMBODIMENT

Figure 1A:
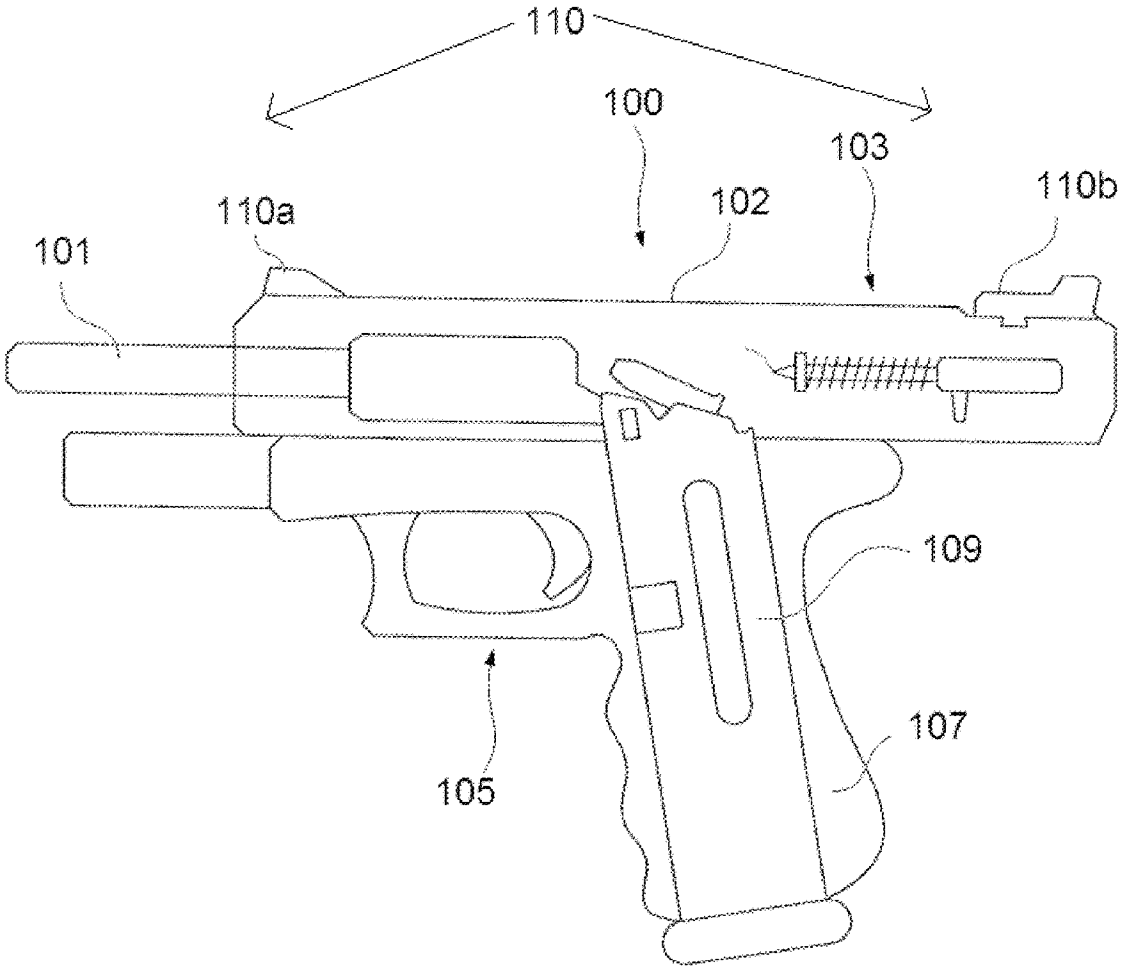
FIG. 1A is a cross-sectional view of a firearm with sight.

Reference will now be made to the drawings wherein like numerals refer to like parts throughout. FIG. 1A shows a typical firearm 100 that is equipped with one embodiment of a magnetically stabilized sight 110. In this implementation, the firearm 100 comprises a semiautomatic pistol having a slide 102 but it will be appreciated that the sight 110 described herein can be used with any type of firearm including other types of pistols, rifles, shotguns and the like.

The sight 110 includes a front sight 110*a* positioned adjacent a front 104 of the barrel of the firearm and a rear sight 110*b* that is positioned adjacent the rear 106 of the firearm 100. The firearm 100 in this embodiment comprises a semiautomatic pistol having a barrel 101, a receiver 103, a trigger assembly 105 a grip 107 that houses a magazine 109. In this specific implementation, the front sight 110*a* and rear sight 110*b* are mounted on the slide 102 of the pistol but it will be appreciated that the sights can be mounted directly to the barrel of a firearm or onto the outer housing of a receiver of a firearm without departing from the spirit and scope of the present teachings.

Figure 1B:
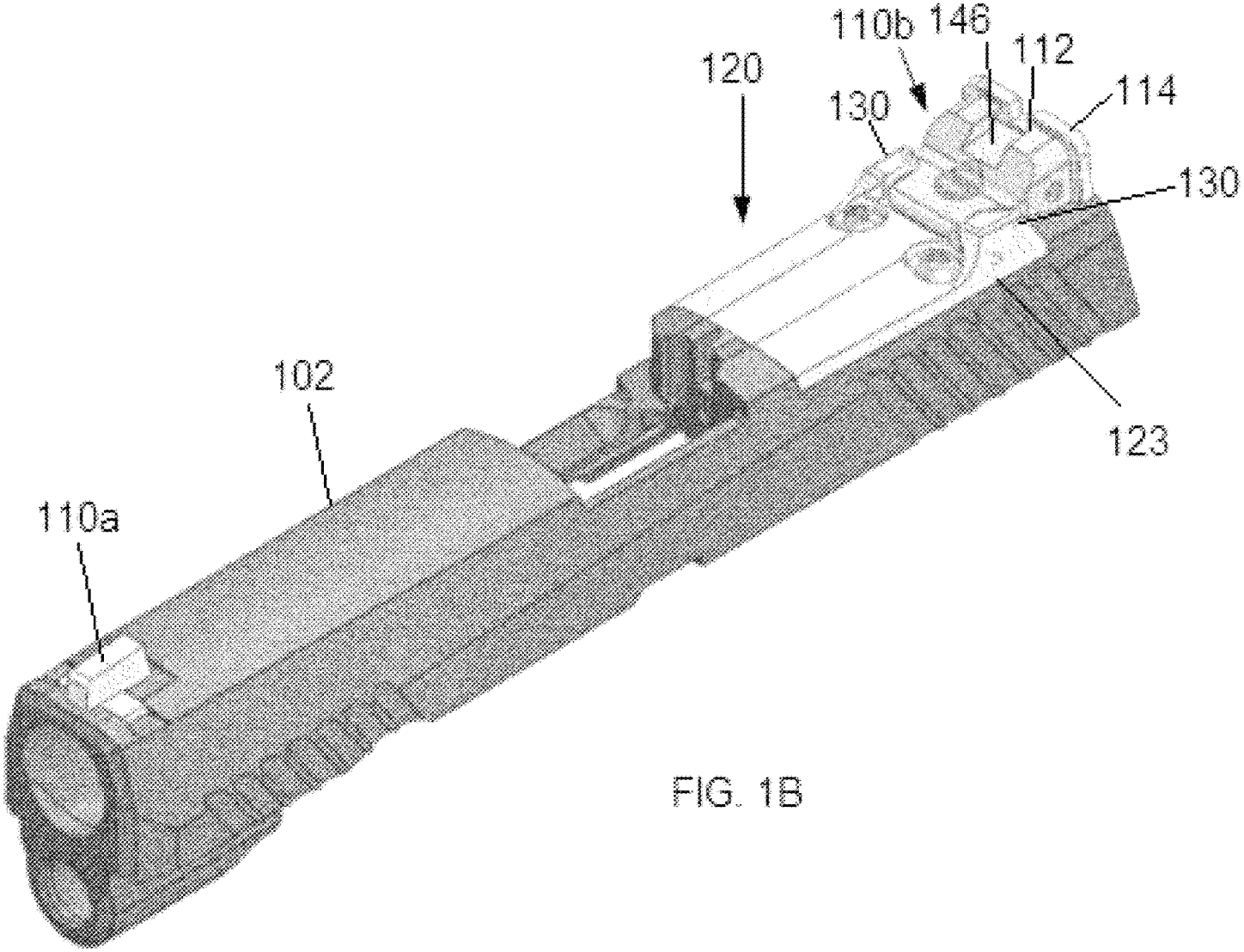
FIG. 1B is a detailed view of a portion of the firearm of FIG. 1A.
Figure 2:
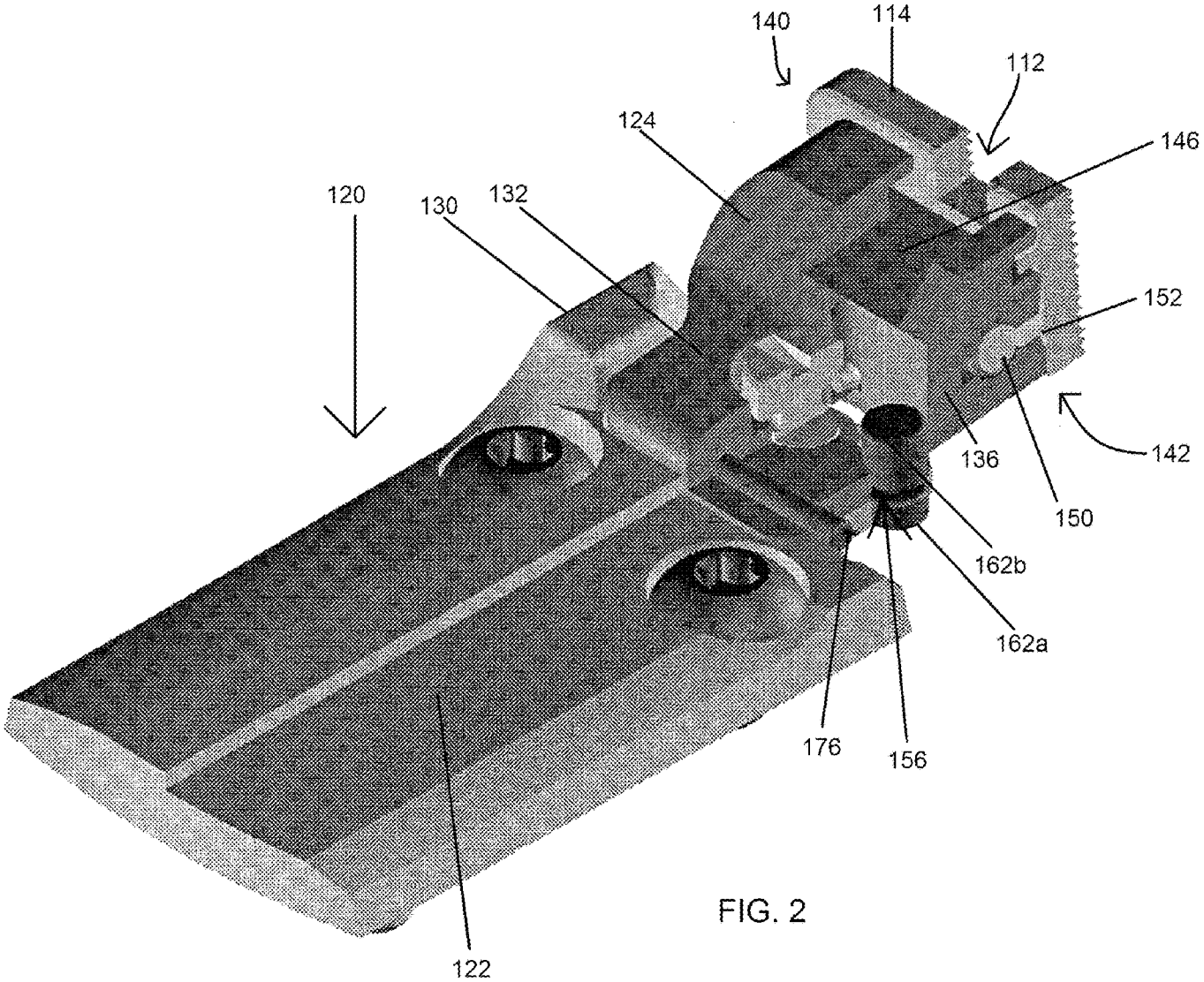
FIG. 2 is an cut-a-way perspective view illustrating the magnetically stabilized sight of FIG. 1B in greater detail.

As is also shown in FIGS. 1 and 2, the rear sight 110*b* includes a plate or sight member 114 that defines a sighting aperture 112 and the plate 114 is mounted so as to generally be perpendicular to the axis of the barrel of the firearm. The front sight 110*a* includes a blade or other upwardly extending protrusion. The shooter sights the firearm 100 by looking through the aperture 112 and moving the firearm 100 so that the front sight 110*a* appears in the aperture 112 and then the aligned front sight 110*a* and rear sight 110*b* are aligned with a desired point of aim of the firearm.

The aperture 112 is shown as a vertically extending slot; however, it will be appreciated that any of a number of known aperture configurations, including circular openings, other forms of grooves, projection-type sights and optical or lighted sights can be used without departing from the spirit of the present invention. Similarly, the front sight 110*a* can also have a plurality of different configurations known in the art without departing from the spirit and scope of the instant application.

The rear sight 110*b* is mounted to the firearm via a mounting assembly 120 which, in this implementation, includes a mounting plate 122 that is positioned within a groove 123 that is formed on the slide 102 of the firearm 100. It will, however, be appreciated that various other mounting methods can be used to mount the rear sight 110*b* to the firearm without departing from the spirit of the instant application. In this application, the plate 114 is attached to the mounting plate 122 via a swing 124 that is preferably pivotally mounted to a pivot pin 126 captured between two mounting brackets 130 of the mounting plate 122. This pivotable attachment permits the swing 124 to be moved vertically upwards and downwards with respect to the mounting assembly 120 to thereby adjust the vertical height of the plate 114 in the manner that will be described in greater detail below.

The swing 124 has a pivot member 132 with an aperture 134 that receives the pivot pin 126. The pivot member 132 widens into an adjustment housing 136 that houses a horizontal or windage adjustment mechanism 142 and also defines a mounting location for the plate 114 at the outer end of the adjustment housing 136. The mounting location 140 receives the plate or sight member 114 having the aperture 112 in such as way that the plate 114 can be moved by the shooter in the horizontal or windage direction by manipulation of the horizontal adjustment mechanism 142.

The adjustment housing 136 includes a slot 146 that is bigger than the slot 112 formed in the plate 114 so that the plate 114 can be adjusted horizontally with respect to the slot 146 while still maintaining a sight path the front sight. The horizontal adjustment mechanism 142 includes an adjustment screw 150 that engages with a movable block 152 and the plate 114 is mounted to the block 152. The adjustment screw 150 can be spring biased but rotational movement of the adjustment screw 150 results in horizontal movement of the block 152 and of the plate 114 that is mounted thereto.

Figure 3:
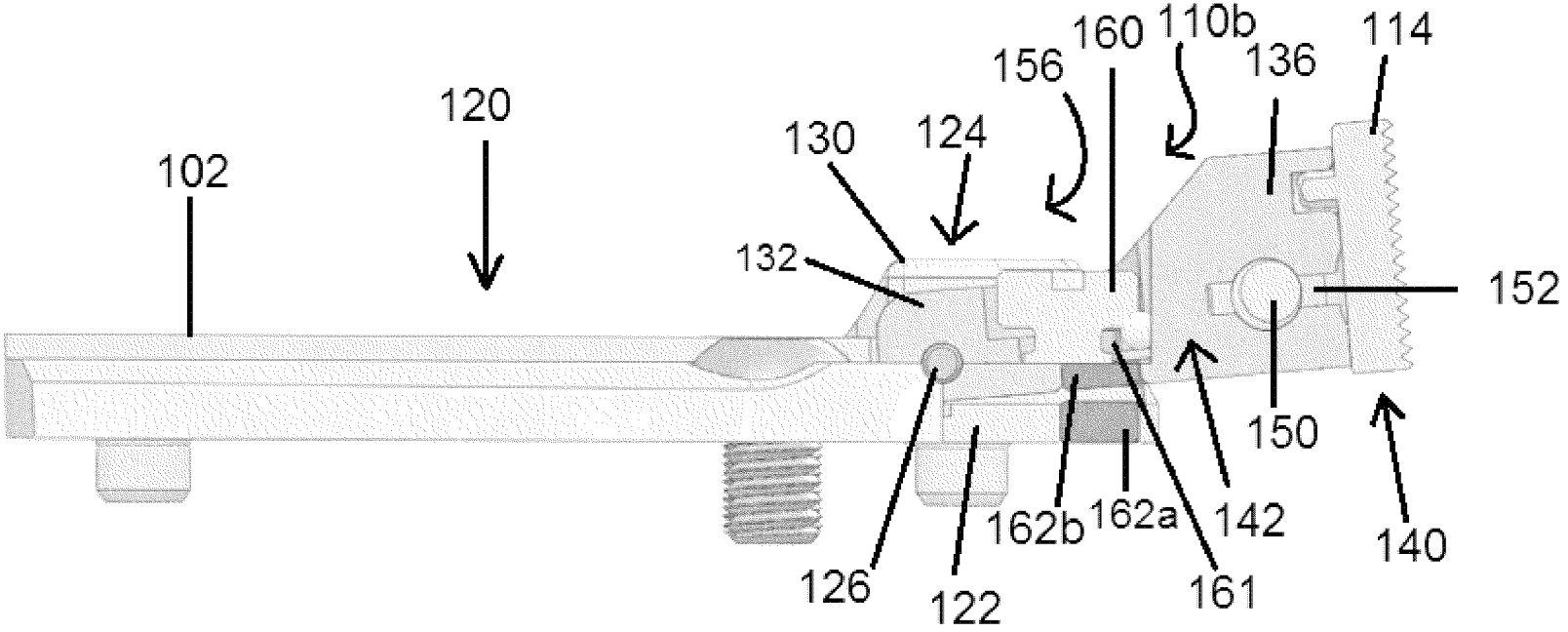
FIG. 3 is a cross-sectional view of the sight in FIG. 2.

As is also shown in FIGS. 2 and 3, the rear sight 110*b* also includes a vertical adjustment assembly 156 that includes a vertical adjustment screw 160 that extends through the swing part 124 and engages with the mounting plate 122 or a component of the assembly 110*b* fixed to the mounting plate 122 or the slide 102. The location of the flanges 161 of the vertical adjustment screw 160 defines the amount of vertical travel that the swing part 124 can pivot. However, the swing part 124 is biased by gravity toward the mounting plate 122 when the firearm 100 is maintained in a horizontal direction.

To address this, one or more magnets 162*a* are mounted in the mounting plate 122 and oppositely charged magnets 162*b* are mounted in the swing part 124. The oppositely charged magnets magnetically repel each other and urge the swing part 124 up against the lip of the vertical adjustment screw 160 to maintain the swing part 124, and thus the plate 114 with the aperture 112 at a desired orientation. In this implementation, there are opposed pairs of magnets 162 positioned on either side of the vertical adjustment screw 160 In one embodiment, the magnets 162*a* are 0.125" in diameter, have a height 0.0625" and have a strength of 5,233 Gauss and the magnets 162*b* are also 0.125" in diameter, have a height of 0.0625" and have a strength of 6,619 Gauss.

Since the magnets 162 form magnetic fields the repulsive forces are not as affected by the arc motion of the swing part 124 as it pivots about the pivot pin 126. Consequently, the vertical position of the plate 114 with the aperture 112 can be positioned more precisely with less binding than with systems that use linear springs as the biasing member to urge a pivoting member upwards along an arc to the height set by the vertical adjustment screw 160.

Although the foregoing has shown, illustrated and described various embodiments and implementations of the present invention it will be apparent by those of ordinary skill in the art that various substitutions, changes and variations of the uses thereof may be made without departing from either the scope or teachings of the present invention. Consequently, the present invention should not be limited to the foregoing but should be defined by the appended claims.

What is claimed is:

1. A sight assembly for a firearm comprising:

a mounting assembly that is adapted to be attached to a firearm in a fixable relationship with respect to the barrel of the firearm;

a swing member that is pivotally attached to the mounting assembly wherein the swing member defines a mounting location;

a plate having a sighting aperture formed therein mounted on the mounting location of the swing member, wherein a vertical position of the plate is adjustable by pivoting of the swing member with respect to the mounting assembly; and a magnetic biasing component that urges the swing member away from the mounting assembly to maintain the plate at a desired vertical location.

2. The sight assembly of claim 1 wherein the mounting assembly comprises a mounting plate that is sized to be positioned within a groove formed in a slide of a semiautomatic firearm.

3. The sight assembly of claim 2, wherein the mounting plate includes two brackets and a pivot pin extending between the brackets and wherein the swing member includes an aperture that receives the pin so that the swing member is cantilevered with respect to the pivot pin.

4. The sight assembly of claim 1, wherein the swing includes a vertical adjustment mechanism and a horizontal adjustment mechanism that adjusts the vertical and horizontal location of the aperture of the plate.

5. The sight assembly of claim 4, wherein the horizontal adjustment mechanism comprises a screw that is attached to a member and the member defines a mounting location for the plate such that rotational movement of the screw results in translational movement of the plate.

6. The sight assembly of claim 1, wherein a first member is positioned in the swing member that is adjustable to define a pivoting height of the swing member.

7. The sight assembly of claim 6, wherein the first member comprises a screw that engages with the swing member and the mounting assembly.

8. The sight assembly of claim 6, wherein the magnetic biasing component comprises magnets positioned so as to urge swing member to the pivoting height of the swing.

9. The sight assembly of claim 8, wherein the magnets comprise a first and second set of opposed magnets mounted in the mounting assembly and the swing member.

10. The sight assembly of claim 1, wherein the sighting aperture comprises a slot, an opening or a light projecting component.

11. A sight assembly for a firearm comprising:

a mounting assembly that is adapted to be attached to a firearm in a fixable relationship with respect to the barrel of the firearm;

a first movement member that is attached to the mounting assembly so as to be movable with respect thereto in a first direction wherein the first movement member defines a mounting location;

a sight mounted on the mounting location of the first movement member, wherein a first position of the sight is adjustable by movement of the first movement member with respect to the mounting assembly in the first direction; and a magnetic biasing component that urges the first movement member away from the mounting assembly to maintain the sight at a desired first position.

12. The sight assembly of claim 11, wherein the mounting assembly comprises a mounting plate that is sized to be positioned within a groove formed in a slide of a semiautomatic firearm.

13. The sight assembly of claim 12, wherein the plate includes two brackets and a pivot pin extending between the brackets and wherein the first movement member is a vertical movement member and includes an aperture that receives the pin so that the vertical movement member is cantilevered and pivots with respect to the pivot pin.

14. The sight assembly of claim 13, wherein a fixing member is positioned in the vertical movement member that is adjustable to define a pivoting height of the vertical movement member.

15. The sight assembly of claim 14, wherein the fixing member comprises a screw that engages with the vertical movement member and the mounting assembly.

16. The sight assembly of claim 15, wherein the magnetic biasing component comprises magnets positioned so as to urge vertical movement member to the pivoting height of the vertical movement member.

17. The sight assembly of claim 16, wherein the magnets comprise a first and second set of opposed magnets mounted in the mounting assembly and the vertical movement member.

18. The sight assembly of claim 11, wherein the sight comprises a slot, a closed opening or a light projecting component.

* * * * *